US011441250B2

(12) United States Patent
Jiang et al.

(10) Patent No.: US 11,441,250 B2
(45) Date of Patent: Sep. 13, 2022

(54) KNITTING METHOD FOR WARP KNITTED JACQUARD THREE-COLOR FIGURED FABRIC

(71) Applicant: JIANGNAN UNIVERSITY, Jiangsu (CN)

(72) Inventors: Gaoming Jiang, Jiangsu (CN); Honglian Cong, Jiangsu (CN); Zhijia Dong, Jiangsu (CN); Haisang Liu, Jiangsu (CN); Bo Liu, Jiangsu (CN)

(73) Assignee: JIANGNAN UNIVERSITY, Wuxi (CN)

( * ) Notice: Subject to any disclaimer, the term of this patent is extended or adjusted under 35 U.S.C. 154(b) by 362 days.

(21) Appl. No.: 16/608,849

(22) PCT Filed: Dec. 18, 2018

(86) PCT No.: PCT/CN2018/121766
§ 371 (c)(1),
(2) Date: Oct. 27, 2019

(87) PCT Pub. No.: WO2019/237702
PCT Pub. Date: Dec. 19, 2019

(65) Prior Publication Data

US 2020/0308739 A1 Oct. 1, 2020

(30) Foreign Application Priority Data

Jun. 12, 2018 (CN) ..... 201810601097.X

(51) Int. Cl.
*D04B 21/08* (2006.01)
*D04B 21/16* (2006.01)
*D04B 21/18* (2006.01)

(52) U.S. Cl.
CPC ..... *D04B 21/08* (2013.01); *D04B 21/16* (2013.01); *D04B 21/18* (2013.01);
(Continued)

(58) Field of Classification Search
USPC ..... 66/207
See application file for complete search history.

(56) References Cited

U.S. PATENT DOCUMENTS 4,055,969 A * 11/1977 Wilkens ..... D04B 21/02 66/204
4,601,940 A * 7/1986 Fischer ..... D04B 21/18 428/178

(Continued)

FOREIGN PATENT DOCUMENTS

CN 101545175 A 9/2009
CN 102425032 A 4/2012

(Continued)

OTHER PUBLICATIONS

Liu, Haisang, et al. "Lapping Modeling of Looped Warp Knitted Jacquard Fabrics Based on Web." Journal of Engineered Fibers and Fabrics: vol. 15:1-13, Journals.sagepub.com/Home/Jef, 2020, https://journals.sagepub.com/doi/pdf/10.1177/1558925020979300. (Year: 2020).*

(Continued)

*Primary Examiner* — Khoa D Huynh
*Assistant Examiner* — Grace Huang
(74) *Attorney, Agent, or Firm* — MagStone Law, LLP; Enshan Hong

(57) ABSTRACT

A knitting method for a warp knitted jacquard three-color figured fabric comprising: (1) defining the basic traverse information of a jacquard bar in non-offset state; (2) A-color pattern area is composed of jacquard pattern texture and jacquard pattern needle supplement texture; (3) B-color pattern area is composed of jacquard pattern texture and jacquard pattern needle supplement texture; (4) a mesh structure of C-color ground net area is composed of jacquard mesh texture and ground bar texture; (5) a pattern contour area is formed by using two jacquard bars to bar the outer (Continued)

contour of the A-color pattern area or the outer contour of the B-color pattern area; (6) the elastic area is composed of a ground bar texture, and a ground bar is used to knit the elastic area texture.

5 Claims, 4 Drawing Sheets

(52) U.S. Cl.
CPC ..... *D10B 2331/02* (2013.01); *D10B 2331/04* (2013.01); *D10B 2331/10* (2013.01)

(56) References Cited

U.S. PATENT DOCUMENTS 5,339,657 A * 8/1994 McMurray ..... D04B 21/10 66/195
5,586,454 A * 12/1996 Matsuda ..... A44B 19/343 66/193
5,855,125 A * 1/1999 Lohmueller ..... D06C 11/00 66/196
6,105,401 A * 8/2000 Chadeyron ..... D04B 1/22 66/195
6,199,410 B1 * 3/2001 Rock ..... D04B 21/02 442/304
7,076,974 B1 * 7/2006 Chen ..... D04B 21/10 66/195
7,152,438 B2 * 12/2006 Matsuda ..... A44B 19/343 66/192
7,174,750 B2 * 2/2007 Shirasaki ..... D04B 21/16 66/195
7,213,421 B2 * 5/2007 Shirasaki ..... D04B 21/14 66/193
7,235,504 B2 * 6/2007 Shirasaki ..... A47C 31/006 442/304
7,293,433 B1 * 11/2007 McMurray ..... D04B 21/08 66/170
7,293,434 B2 * 11/2007 Ikeguchi ..... A44B 19/40 66/193
7,797,967 B2 * 9/2010 Shirasaki ..... D04B 21/207 66/195
8,181,491 B2 * 5/2012 Meneghin ..... D04B 21/12 66/195
8,448,475 B2 * 5/2013 Akao ..... D04B 21/16 66/193
8,904,829 B2 * 12/2014 Keitch ..... D04B 21/16 66/195
10,030,328 B2 * 7/2018 Lonati ..... D04B 21/08
10,443,165 B2 * 10/2019 Cai ..... D04B 23/06
10,829,877 B2 * 11/2020 Takayama ..... D04B 21/06
2001/0010164 A1 * 8/2001 Ternon ..... D04B 21/02 66/207
2003/0106346 A1 * 6/2003 Matsumoto ..... D04B 21/10 66/195
2004/0176658 A1 * 9/2004 McMurray ..... D04B 21/10 66/193
2015/0176162 A1 * 6/2015 Relats Manent ..... D04B 21/16 66/195
2017/0107649 A1 * 4/2017 Lonati ..... D04B 21/207

FOREIGN PATENT DOCUMENTS

CN 103541146 A 1/2014
CN 104846536 A 8/2015
CN 106048877 A 10/2016
CN 107988699 A 5/2018
CN 108691088 A 10/2018
DE 19801601 C1 * 3/1999 ..... D04B 21/10
EP 3272921 A1 * 1/2018 ..... D04B 21/10
JP 2009256829 A * 11/2009 ..... D04B 21/06
JP 2017150094 A 8/2017

OTHER PUBLICATIONS

International Search Report dated Feb. 14, 2019 for related PCT/CN2018/121766 filed Dec. 18, 2018.

* cited by examiner

KNITTING METHOD FOR WARP KNITTED JACQUARD THREE-COLOR FIGURED FABRIC

PRIORITY CLAIM

This is a U.S. national stage of application No. PCT/CN2018/121766, filed on Dec. 18, 2018, which claims priority from China Patent Application Serial Number CN201810601097X, filed on Jun. 12, 2018, the content of which is incorporated here by reference.

BACKGROUND OF THE INVENTION

1. Technical Field

The present invention relates to a warp knitting method, in particular to a warp knitting jacquard three-color jacquard fabric knitting method, belonging to the field of textile technology.

2. Background Art

RSJ warp knitted jacquard fabric refers to the elastic or inelastic, ground mesh tight or mesh-like, three-dimensional or flat jacquard fabric produced on the high-machine RSJ jacquard raschel warp knitting machine. These fabrics have been widely used in women's underwear, swimwear, body shapers, sportswear and casual wear. The RSJ warp knitting machine have high machine speed, high productivity, and the production fabrics are exquisite and delicate, with excellent quality and smooth hand feeling. The warp-knitted longitudinal coil is stable in structure and is not easy to be stripped. With the application of jacquard bar, RSJ fabric can not only produce decorative fabrics with rich pattern and mesh effect, but also can produce structural fabrics with different functional areas. The existing knitting method is mainly used for the production of monochromatic fabrics, at present, only conventional two-color fabrics are available, and the main method is to achieve the partial two-color effect of the regular straight strip region through lapping segmentation on the ground bars.

RSJ warp jacquard three-color jacquard fabric is a special three-color jacquard fabric which is different from monochrome fabric and conventional two-color fabric. It has special requirements for knitting principle, structure definition and raw material. The techniques and raw materials used in the production of conventional fabrics cannot meet the requirements of such fabrics.

SUMMARY OF THE INVENTION

The object of the present invention is to overcome the deficiencies in the prior technology, and to provide a knitting method for a warp knitted jacquard three-color jacquard fabric, which can realize the production of three-color decorative jacquard pattern fabric with fine texture and fine transparency, and has the function of breathable and anti-shedding.

According to the technical scheme provided by the present invention, a knitting method of a warp knitted jacquard three-color jacquard fabric is produced on a high knitting gauge RSJ warp knitting machine, and the RSJ warp knitting machine RSJ warp knitting machine includes two half knitting gauge jacquard bars forming a full knitting gauge bar for the same direction of the mat yarn movement, the order of machine bar from front to back is jacquard bar JB1.1*a*, JB1.2, two ring bar GB2, GB3 and one wiper bar GB4, jacquard bar JB1.1 is used in odd longitudinal lines, JB1.2 is used in even longitudinal lines, JB1.1 and JB1.2 are two half knitting gauge jacquard bars and form a full knitting gauge bar, stitch-forming guide bars GB2 and GB3 are full gauge knitting, weft insertion guide bar GB4 is full gauge knitting; It is characterized in that the knitting method of warp three-color jacquard fabric is used for knitting a three-color jacquard fabric, which is include an A-color pattern area, a B-color pattern area, a C-color ground mesh area, a pattern outline area and an elastic area. The specific knitting methods are as follows:

Define the basic traverse information of the jacquard bar in the non-offset state. The specific corresponding action information of the lapping form and the jacquard needle is as follows: Jacquard bar JB1.1: 1-0/1-2//(HH/HH//) is covered with A-color yarn; Jacquard bar JB1.2: 1-0/1-2//(HH/HH//) is covered with B-color yarn; loop formation guide bar GB2, GB3 are covered with C-Color yarn, elastic loop forming guide bar GB4 is covered with spandex yarn;

(2) Knitting of A-color pattern area: The A-color pattern area is composed of jacquard pattern and jacquard replenishing pattern, and the chain notation and offset information of jacquard pattern is: JB1.1: 1-0/2-3//(HH/TT//), JB1.2: 1-0/0-1//(TT/HH//), the chain notation and offset information of the is, JB1.1: 1-0/2-3//(HH/TT//), JB1.2: 1-0/1-2//(HH/HH//);

(3) Knitting of B-color pattern area: The B-color pattern area is composed of jacquard pattern and jacquard replenishing pattern, and the chain notation and offset information of jacquard pattern is: JB1.1: 1-0/0-1//(TT/HH//), JB1.2: 1-0/2-3//(HH/TT//), the chain notation and offset information of the jacquard replenishing pattern is: JB1.1: 1-0/1-2//(HH/HH//), JB1.2: 1-0/2-3//(HH/TT//);

(4) Knitting of the C-color ground mesh area: The C-color ground mesh area is a mesh structure composed of a jacquard mesh pattern and a ground bar pattern;

(5) Knitting of the pattern outline area: the pattern outline area is the pattern used for the outer contour of the A-color pattern area or the outer contour of the B-color pattern area, and the pattern of the outline is formed by two jacquard bars, and the chain notation of the A-color pattern contour tissue is JB1.1: 1-0/1-2//(HH/HH//) and JB1.2: 1-0/0-1//(TT/HH//), the chain notation of the B-color contour pattern is: JB1.1: 1-0/0-1//(TT/HH//), JB1.2: 1-0/1-2//(HH/HH//);

(6) Knitting of the elastic area: consisting of a ground bar pattern which uses a ground bar to knit the elastic area pattern.

Further, in the step (4), the jacquard mesh pattern is formed by a jacquard chain stitch, and the chain notation and offset information of jacquard chain stitch is JB1.1: 1-0/0-1//(TTHH//) and JB1.2: 1-0/0-1//(TT/HH//); Two stitch-forming guide bar GB2 and GB3 are used as ground bar stitches, and the chain notation is GB2: 2-3/2-1/1-2/1-0/1-2/2-1//, GB3: 1-0/1-2/2-1/2-3/2-1/1-2//.

Further, in the step (4), the jacquard mesh pattern is formed by a jacquard chain tissue, and two loop forming guide bars GB2 and GB3 are used as compacting patterns to form ground bar patterns, the chain notation is GB2: 1-0/0-1//, GB3: 0-0/2-2//.

Further, in the step (6), the chain notation is GB4: 1-1/0-0//.

Further, the bar JB1.1 is threaded with 20 D semi-dull PET filaments, and the bar JB1.2 is threaded with 20 D polyester semi-dull filaments, bar GB2 and GB3 are threaded with 20 D semi-dull PET filaments, bar GB4 is threaded 70 D spandex, all bars are covered with the full yarn threading.

The knitting method of the warp knitted jacquard three-color jacquard fabric can realize the production of three-color decorative jacquard pattern fabric with fine texture and fine transparency, and has the function of breathable and anti-shedding.

DESCRIPTION OF PREFERRED EMBODIMENTS

The invention will now be further described with reference to the specific drawings.

Figure 1:
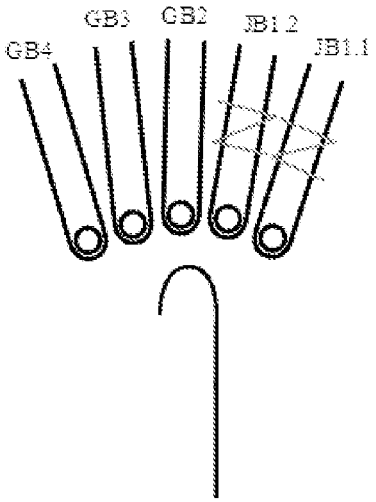
FIG. 1 The lateral diagram of a stitch-forming guide bar used in the RSJ warp knitting machine of the present invention.
Figure 2:
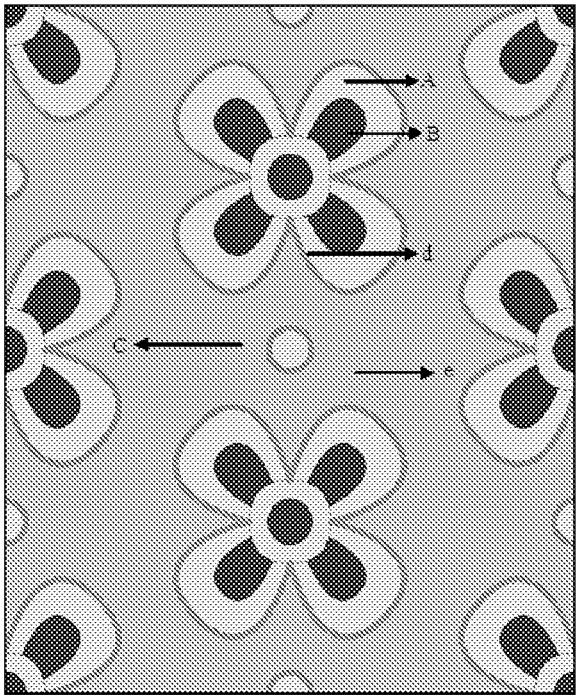
FIG. 2 The schematic plan view of the RSJ warp knitted jacquard three-color jacquard fabric according to the present invention.

As shown in FIG. 1, the knitting method for warp knitted jacquard three-color fabric is produced on a high-machine RSJ warp knitting machine. RSJ warp knitting machine includes two half knitting gauge jacquard bars forming a full knitting gauge bar for the same direction of the mat yarn movement, the order of machine bar from front to back is jacquard bar JB1.1, JB1.2, two ring bar GB2, GB3 and one wiper bar GB4, jacquard bar JB1.1 is used in odd longitudinal lines, JB1.2 is used in even longitudinal lines, JB1.1 and JB1.2 are two half knitting gauge jacquard bars and form a full knitting gauge bar, stitch-forming guide bars GB2 and GB3 are full gauge knitting, weft insertion guide bar GB4 is full gauge knitting;

The knitting method of the warp knitted jacquard three-color jacquard fabric is used for knitting a three-color jacquard fabric, including an A-color pattern area, a B-color pattern area, a C-color ground mesh area, a pattern outline area and an elastic area. The specific knitting methods are as follows:

(1) Define the basic traverse information of the jacquard bar in the non-offset state. The specific corresponding action information of the lapping form and the jacquard needle is as follows: Jacquard bar JB1.1: 1-0/1-2//(HH/HH//) is covered with A-color yarn; Jacquard bar JB1.2: 1-0/1-2//(HH/HH//) is covered with B-color yarn; Loop forming guide bar GB2, GB3 are covered with C-Color yarn, elastic loop forming guide bar GB4 is covered with spandex yarn;

(2) Knitting of A-color pattern area: The A-color pattern area is composed of jacquard pattern and jacquard replenishing pattern, and the chain notation and offset information of jacquard pattern is: JB1.1: 1-0/2-3//(HH/TT//), JB1.2: 1-0/0-1//(TT/HH//), the chain notation and offset information of the jacquard replenishing pattern is JB1.1: 1-0/2-3//(HH/TT//), JB1.2: 1-0/1-2//(HH/HH//);

(3) Knitting of B-color pattern area: The B-color pattern area is composed of jacquard pattern and jacquard replenishing pattern, and the chain notation and offset information of jacquard pattern is: JB1.1: 1-0/0-1//(TT/HH//), JB1.2: 1-0/2-3//(HH/TT//), the chain notation and offset information of the jacquard replenishing pattern is: JB1.1: 1-0/1-2//(HH/HH//), JB1.2: 1-0/2-3//(HH/TT//);

(4) Knitting of the C-color ground mesh area: the C-color ground mesh area is a mesh structure composed of a jacquard mesh pattern and a ground bar pattern;

First way, the jacquard mesh pattern is formed by a jacquard chain stitch, and the chain notation and offset information of jacquard chain stitch is JB1.1: 1-0/0-1//(TT/HH//) and JB1.2: 1-0/0-1//(TT/HH//); Two stitch-forming guide bars GB2 and GB3 are used as ground bar patterns, and the chain notation is GB2: 2-3/2-1/1-2/1-0/1-2/2-1//, GB3: 1-0/1-2/2-1/2-3/2-1/1-2//.

The other way, the jacquard mesh pattern is formed by a jacquard chain stitch, and two stitch-forming guide bars GB2 and GB3 are used as compacting patterns to form ground bar patterns, the chain notation is GB2: 1-0/0-1//, GB3: 0-0/2-2//.

The mesh structure of the mesh in the C-color ground area can flexibly formulate a regular organizational structure as needed;

(5) Knitting of the pattern outline area: the pattern outline area is the pattern used for the outer contour of the A-color pattern area or the outer contour of the B-color pattern area, and the pattern of the outline is formed by two jacquard bars, and the chain notation of the A-color pattern contour pattern is JB1.1: 1-0/1-2//(HH/HH//) and JB1.2: 1-0/0-1//(TT/HH//), the chain notation of the B-color contour pattern is: JB1.1: 1-0/0-1//(TT/HH//), JB1.2: 1-0/1-2//(HH/HH//);

(6) Knitting of the elastic area: consisting of a ground bar pattern, using a ground bar to knit the elastic area, the chain notation is GB4: 1-1/0-0//. The structure of elastic area can be flexibly formulated according to the needed of fabric elasticity.

EXAMPLE 1

An two-color RSJ warp knitted jacquard fabric is produced on the RSJ-jacquard raschel warp knitting machine with gauge E28 (28 needles per inch), the machine type is RSJ4/1 with 4 bars in total; As shown in FIG. 1, four bars are used in the knitting process of the present invention, and the order of the bars from the front of the machine to the back of the machine is one full knitting gauge needle bar composed of two half knitting gauge bars JB1.1 and JB1.2 and three looped ground bars GB2, GB3, GB4; The needle interval on the need bar are numbered from the direction of the head to the tail of the machine. The knitting needle interval are numbered as 0, 1, 2, 3 . . . , which are used in the present invention to indicate the movement of the guide needles;

The specific knitting process is:

Selected raw materials: JB1.1: 20 D semi-dull PET filament, JB1.2: 20 D polyester semi-dull filament, GB2, GB3: 20 D semi-dull PET filament, GB4: 70 D spandex, all bars are covered with the full yarn threading.

Figure 3:
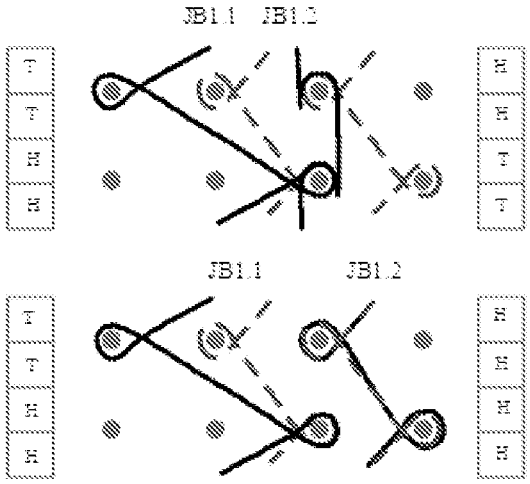
FIG. 3 The lapping diagram in A-color pattern area of the present invention.
Figure 4:
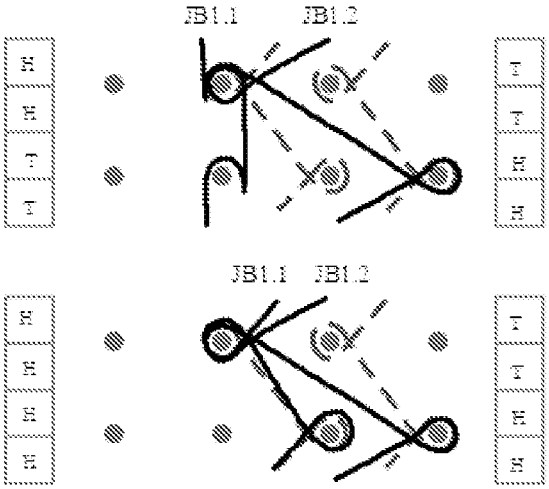
FIG. 4 The lapping diagram in B-color pattern area tissue of the present invention.
Figure 5:
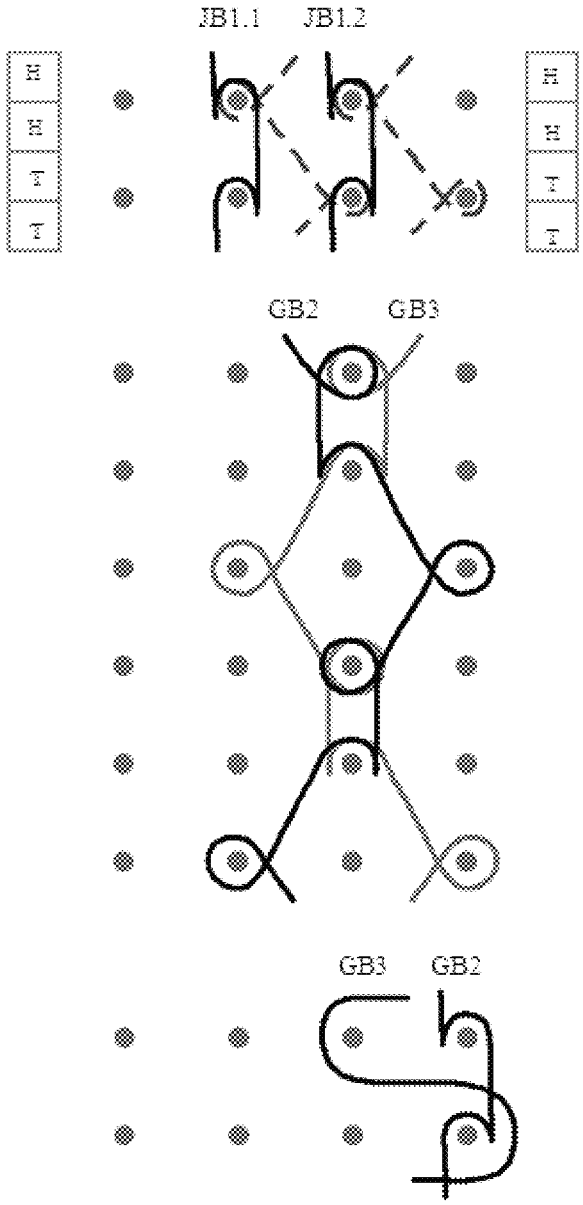
FIG. 5 The lapping diagram in C-color pattern area tissue of the present invention.
Figure 6:
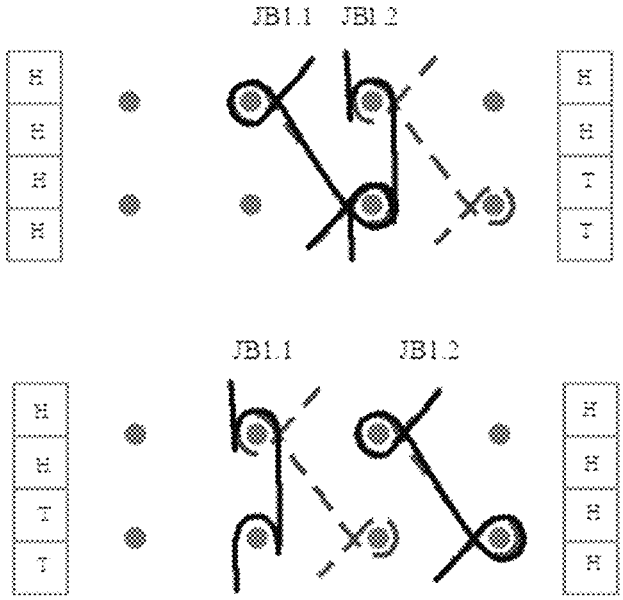
FIG. 6 The lapping diagram in the patterned contour region d of the present invention.

Lateral movement chuck customization or parameters of electronic displacement bars setting: JB1.1: 1-0/1-2//(HH/HH//), JB1.2: 1-0/1-2//(HH/HH//), GB2: 2-3/2-1/1-2/1-0/1-2/2-1//, GB3: 1-0/1-2/2-1/2-3/2-1/1-2//, GB4: 1-1/0-0//;

Design pattern, define the action information of each jacquard needle in each sequence: design the pattern using the warp knitted fabric CAD system, use the number of rows as the flower width, half of the number of rows as the flower height, different effect units using a different color representation to form a jacquard effect bitmap (inspired). In this implementation, the flower width is 170 and the flower height is 330. The specific yarn mat movement and the corresponding jacquard needle motion information of the A-color pattern area a, the B-color pattern area b, the pattern contour area c, the ground mesh area d, and the elastic area e are as follows:

As shown in FIG. 3, the lapping notation and the lapping information of the A-color pattern area a are as follows: pattern: JB1.1: 1-0/2-3//(HH/TT//), JB1.2: 1-0/0-1//(TT/HH//), a-color needle compensate pattern: JB1.1: 1-0/2-3//(HH/TT//), JB1.2: 1-0/1-2//(HH/HH//);

As shown in FIG. 4, the lapping notation and the lapping information of the B-color pattern area b are as follows: B-color pattern organization: JB1.1: 1-0/0-1//(TT/HH//), JB1.2: 1-0/2-3//(HH/TT//), B color pattern needle organization: JB1.1: 1-0/1-2//(HH/HH//), JB1.2: 1-0/2-3//(HH/TT//);

As shown in FIG. 5, the lapping notation and the lapping information of the offset pattern of the C-color ground mesh area: jacquard chain stitch: JB1.1: 1-0/0-1//(TT/HH//), JB1.2: 1-0/0-1//(TT/HH//), the chain notation of two ground bar mesh stitch: GB2: 2-3/2-1/1-2/1-0/1-2/2-1//, GB3: 1-0/1-2/2-1/2-3/2-1/1-2//;

As shown in FIG. 6, the lapping notation and the lapping information of the offset pattern of the C-color ground mesh area: A-color contour pattern: JB1.1: 1-0/1-2//(HH/HH//), JB1 0.2:1-0/0-1//(TT/HH//), B-color contour pattern: JB1.1: 1-0/0-1//(TT/HH//), JB1.2: 1-0/1-2//(HH/HH//): JB1.1: 1-0/1-2//(HH/HH//) JB1.2: 1-0/0-1//(TT/HH//);

The lapping notation of the elastic area e is: one ground bar of elastic area: GB4: 1-1/0-0//.

The present invention employs a specific Jacquard migration process with two half knitting gauge jacquard bars using two kinds of materials, produce two-color jacquard effect, forming a rich color jacquard pattern. The method can form a two-color jacquard effect without using more bars, enriching the types of existing products, greatly simplifying the knitting method, fundamentally improving design efficiency and production efficiency, and using high-machine number, light yarn and the elastic yarns for knitting, the fabric texture is light and delicate, the hand feels soft and smooth, which is suitable for the close-fitting and tight-fitting underwear products, thereby improving the decoration, product quality and market competitiveness of the warp knitted fabrics.

What is claimed is:

1. A knitting method for warp knitted three-color jacquard fabric produced on a high knitting gauge RSJ warp knitting machine, wherein the RSJ warp knitting machine comprises two half knitting gauge jacquard bars forming a full knitting gauge bar for a same direction of a mat yarn movement, wherein an order of machine bar from front to back is jacquard bar JB1.1, JB1.2, two stitch-forming guide bars GB2, GB3, and one weft insertion guide bar GB4, wherein the jacquard bar JB1.1 is used in odd longitudinal lines, wherein the jacquard bar JB1.2 is used in even longitudinal lines, wherein JB1.1 and JB1.2 are the two half knitting gauge jacquard bars and form a full knitting gauge bar, wherein the stitch-forming guide bars GB2 and GB3 are full gauge knitting, wherein the weft insertion guide bar GB4 is full gauge knitting;

wherein the knitting method of the warp knitted three-color jacquard fabric comprises knitting the three-color jacquard fabric, which comprises an A-color pattern area, a B-color pattern area, a C-color ground mesh area, a pattern outline area, and an elastic area, wherein the specific knitting method comprises the steps of:

(1) defining basic traverse information of the jacquard bars JB1.1, JB1.2 in a non-offset state:

wherein the specific corresponding action information of a lapping form and a jacquard needle is as follows:

the jacquard bar JB1.1: 1-0/1-2//(HH/HH//) is covered with A-color yarn;

the jacquard bar JB1.2: 1-0/1-2//(HH/HH//) is covered with B-color yarn;

the stitch-forming guide bars GB2, GB3 are covered with C-color yarn;

the weft insertion guide bar GB4 is covered with spandex yarn;

(2) knitting the A-color pattern area:

wherein the A-color pattern area is composed of a first jacquard pattern and a first jacquard replenishing pattern, wherein a chain notation and offset state of the first jacquard pattern is:

JB1.1: 1-0/2-3//(HH/TT//),

JB1.2: 1-0/0-1//(TT/HH//);

and a chain notation and offset state of the first jacquard replenishing pattern is:

JB1.1: 1-0/2-3//(HH/TT//),

JB1.2: 1-0/1-2//(HH/HH//);

(3) knitting the B-color pattern area:

wherein the B-color pattern area is composed of a second jacquard pattern and a second jacquard replenishing pattern, wherein a chain notation and offset state of the second jacquard pattern is:

JB1.1: 1-0/0-1//(TT/HH//),

JB1.2: 1-0/2-3//(HH/TT//), and a chain notation and offset state of the second jacquard replenishing pattern is:

JB1.1: 1-0/1-2//(HH/HH//),

JB1.2: 1-0/2-3//(HH/TT//);

(4) knitting the C-color ground mesh area:

wherein the C-color ground mesh area is a mesh structure composed of a jacquard mesh pattern and a first ground bar pattern;

(5) knitting the pattern outline area:

wherein the pattern outline comprises A-color pattern contour structure and B-color contour pattern used, respectively, for an outer contour of the A-color pattern area and an outer contour of the B-color pattern area, wherein the pattern of the pattern outline area is formed by the two half knitting gauge jacquard bars, wherein a chain notation of the A-color pattern contour structure is:

JB1.1: 1-0/1-2//(HH/HH//),

JB1.2: 1-0/0-1//(TT/HH//), and a chain notation of the B-color contour pattern is:

JB1.1: 1-0/0-1//(TT/HH//),

JB1.2: 1-0/1-2//(HH/HH//);

(6) knitting the elastic area: consisting of a second ground bar pattern which uses a ground bar to knit the elastic area.

2. The method of claim 1, wherein in the step (4), the jacquard mesh pattern is formed by jacquard chain stitches, wherein the chain notation and offset information of jacquard chain stitch is:

JB1.1: 1-0/0-1//(TT/HH//);

JB1.2: 1-0/0-1/(TT/HH//);

wherein the two stitch-forming guide bars GB2 and GB3 are used in the first ground bar pattern, wherein the chain notation is:

GB2: 2-3/2-1/1-2/1-0/1-2/2-1//,

GB3: 1-0/1-2/2-1/2-3/2-1/1-2//.

3. The method of claim 1, wherein in the (4), the jacquard mesh pattern is formed by a jacquard chain structure, and the two stitch-forming guide bars GB2 and GB3 are used as compacting patterns to form ground bar patterns, wherein the chain notation is:

GB2: 1-0/0-1//, and

GB3: 0-0/2-2//.

4. The method of claim 1 wherein in the step (6), the chain notation of the weft insertion guide bar to form the second ground bar pattern is:

GB4: 1-1/0-0//.

5. The method of claim 1 wherein the bar JB1.1 is threaded with 20D semi-dull PET filaments, and the bar JB1.2 is threaded with 20D polyester semi-dull filaments, the bars GB2 and GB3 are threaded with 20D semi-dull PET filaments, the bar GB4 is threaded with 70D spandex yarns, wherein all the bars are covered with full yarn threading.

* * * * *